US009031469B2

(12) United States Patent
Iwasaki et al.

(10) Patent No.: US 9,031,469 B2
(45) Date of Patent: May 12, 2015

(54) IMAGE FORMING APPARATUS AND PROCESS CARTRIDGE INCORPORATED THEREIN

(75) Inventors: Takuma Iwasaki, Kanagawa (JP); Ken Amemiya, Tokyo (JP); Michiya Okamoto, Kanagawa (JP); Shinya Karasawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 875 days.

(21) Appl. No.: 13/067,559

(22) Filed: Jun. 9, 2011

(65) Prior Publication Data

US 2011/0311277 A1 Dec. 22, 2011

(30) Foreign Application Priority Data

Jun. 18, 2010 (JP) ..... 2010-139598

(51) Int. Cl.
*G03G 15/01* (2006.01)

(52) U.S. Cl.
CPC .... *G03G 15/0194* (2013.01); *G03G 2215/0604* (2013.01)

(58) Field of Classification Search
CPC ..... G03G 15/18; G03G 15/10; G03G 15/334; G03G 15/065
USPC ..... 399/223, 165, 341, 271, 27, 29, 39, 231
See application file for complete search history.

(56) References Cited

U.S. PATENT DOCUMENTS

| | | | | |
|---|---|---|---|---|
| 6,907,204 | B2 * | 6/2005 | Cho | 399/70 |
| 7,373,101 | B2 | 5/2008 | Hozumi et al. | |
| 7,672,635 | B2 | 3/2010 | Hozumi et al. | |
| 2003/0175049 | A1 * | 9/2003 | Ichida et al. | 399/237 |
| 2006/0194662 | A1 | 8/2006 | Hozumi et al. | |
| 2008/0175635 | A1 | 7/2008 | Hozumi et al. | |
| 2008/0193164 | A1 | 8/2008 | Yamamoto et al. | |

(Continued)

FOREIGN PATENT DOCUMENTS

| | | | |
|---|---|---|---|
| JP | 03-164762 | A | 7/1991 |
| JP | 05-011561 | A | 1/1993 |

(Continued)

OTHER PUBLICATIONS

European Search Report dated Oct. 13, 2011 issued in corresponding European Application No. 11170317.9.

(Continued)

*Primary Examiner* — Roy Y Yi

(74) *Attorney, Agent, or Firm* — Harness, Dickey & Pierce, P.L.C.

(57) ABSTRACT

A tandem-type electrophotographic image forming apparatus includes multiple color image forming units using a dry toner, a first black image forming unit using the dry toner, and a second black image forming unit using a wet toner and performs an image formation with the dry toner in a first printing mode and an image formation with the wet toner in a second printing mode. The image formed in the second printing mode with the wet toner is fixed to a recording medium at a temperature lower than the image formed in the first printing mode with the dry toner. Each of the image forming units corresponds to a process cartridge that is removably installable in the tandem-type electrophotographic image forming apparatus and including an image carrier and other image forming components integrally therein.

9 Claims, 2 Drawing Sheets

(56) References Cited

U.S. PATENT DOCUMENTS

| | | | | |
|---|---|---|---|---|
| 2009/0274973 | A1 | 11/2009 | Watanabe et al. | |
| 2010/0061739 | A1 * | 3/2010 | Yang | 399/2 |
| 2011/0026992 | A1 | 2/2011 | Shintani et al. | |
| 2011/0052225 | A1 | 3/2011 | Honjoh et al. | |

FOREIGN PATENT DOCUMENTS

| | | | |
|---|---|---|---|
| JP | 2000-275892 | | 10/2000 |
| JP | 2001-051467 | A | 2/2001 |
| JP | 2002-040752 | A | 2/2002 |
| JP | 2005-274829 | | 10/2005 |
| JP | 2006-309010 | | 11/2006 |
| JP | 2007-057900 | | 3/2007 |
| JP | 2007-108788 | | 4/2007 |
| JP | 2008-076498 | A | 4/2008 |
| JP | 2008-134304 | A | 6/2008 |
| JP | 2009-229626 | | 10/2009 |
| JP | 2009-229687 | | 10/2009 |
| JP | 2010-72249 | | 4/2010 |

OTHER PUBLICATIONS

Japanese Office Action dated Jan. 28, 2014 issued in corresponding Japanese Application No. 2010-139598.

* cited by examiner

IMAGE FORMING APPARATUS AND PROCESS CARTRIDGE INCORPORATED THEREIN

CROSS-REFERENCE TO RELATED APPLICATIONS

The present invention claims priority pursuant to 35 U.S.C. §119 from Japanese Patent Application No. 2010-139598, filed on Jun. 18, 2010 in the Japan Patent Office, the contents and disclosures of which is hereby incorporated by reference herein in its entirety.

BACKGROUND OF THE INVENTION

1. Field of the Invention

Embodiments of the prevent invention relate to a tandem-type electrophotographic image forming apparatus and a process cartridge incorporated therein, and more particularly to a tandem-type electrophotographic image forming apparatus that can frequently print monochrome (black-and-white) images as well as color images and a process cartridge incorporated therein.

2. Description of the Related Art

Tandem-type color image forming apparatuses produce monochrome images (e.g., black-and-white images) as well as color images. Monochrome images are generally printed more frequently than color images, and therefore a photoconductor provided for forming black images can cause mechanical wear relatively easily, as compared to the other photoconductors provided for forming other color images. To address the drawback, various techniques have been considered to extend a life of a black photoconductor to be longer than the other color photoconductors used in a same tandem-type color image forming apparatus.

Regardless of tandem-type image forming apparatuses, energy-saving devices are demanded and needed recently with concerns about the environment. Most of the power used for an image forming apparatus is consumed in a fixing process for fixing a toner image to a recording medium, and therefore a fixing unit and/or toner have been developed to reduce the amount of power consumption.

For example, Japanese Patent Application Publication No. JP 2008-134304 discloses an image forming apparatus that can prevent the extremely short life tendency of a specific (black) electrostatic latent image carrier (photoconductor) by replacing multiple electrostatic latent image carriers at similar intervals or cycles to each other. The image forming apparatus disclosed in Japanese Patent Application Publication No. JP 2008-134304 includes a plurality of electrostatic latent image holders, contact charging means, and a non-contact charging means. The electrostatic latent image holders are formed by stacking a plurality of functional layers, and the component ratio of the respective functional layers of the electrostatic latent image holders corresponding to the contact charging means and the component ratio of the respective functional layers of the electrostatic latent image holder corresponding to the non-contact charging means are different.

By forming the black image forming unit different from the other color image forming units, the image forming apparatus disclosed in Japanese Patent Application Publication No. JP 2008-134304 prevents the life of the black image forming unit from being extremely shortened. Since the same image forming unit is used in a color image printing mode and in a monochrome image printing mode, in a case in which a user prints an extremely large amount of monochrome images, the black image forming unit needs to be replaced at cycles different from the other image forming units.

On the other hand, as described above, to respond to the needs for energy-saving to solve the environmental issued, it is desired to reduce the amount of consumption of power required for operations performed in the image forming apparatus as much as possible.

SUMMARY OF THE INVENTION

The present invention describes an image forming apparatus. In one example, a tandem-type, electrophotographic image forming apparatus includes multiple color image forming units using a color dry toner, a first black image forming unit using a black dry toner, and a second black image forming unit using a black wet toner.

The above-described tandem-type electrophotographic image forming apparatus may perform an image formation with the dry toner in a first printing mode and an image formation with the wet toner in a second printing mode.

The image formed in the second printing mode with the wet toner may be fixed to a recording medium at a temperature lower than the image formed in the first printing mode with the dry toner.

The wet toner may be a non-volatile, high-concentrated liquid toner.

Each of the multiple color image forming units and the first black image forming unit using the dry toner may include an image carrier formed by organic photoconductor (OPC) and the second black image forming unit using the wet toner may include an image carrier formed by amorphous silicon.

The image carrier of each image forming units may be determined to either contact with or separate from a transfer belt, depending on selection of the first printing mode and the second printing mode.

In another example, a process cartridge includes an image carrier, and at least one of a charging unit, a developing unit, and a cleaning unit. The process cartridge is removably installable in the above-described tandem-type electrophotographic image forming apparatus and corresponding to any one of the multiple color image forming units, the first black image forming unit, and the second black image forming unit.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF PREFERRED EMBODIMENTS

Figure 1:
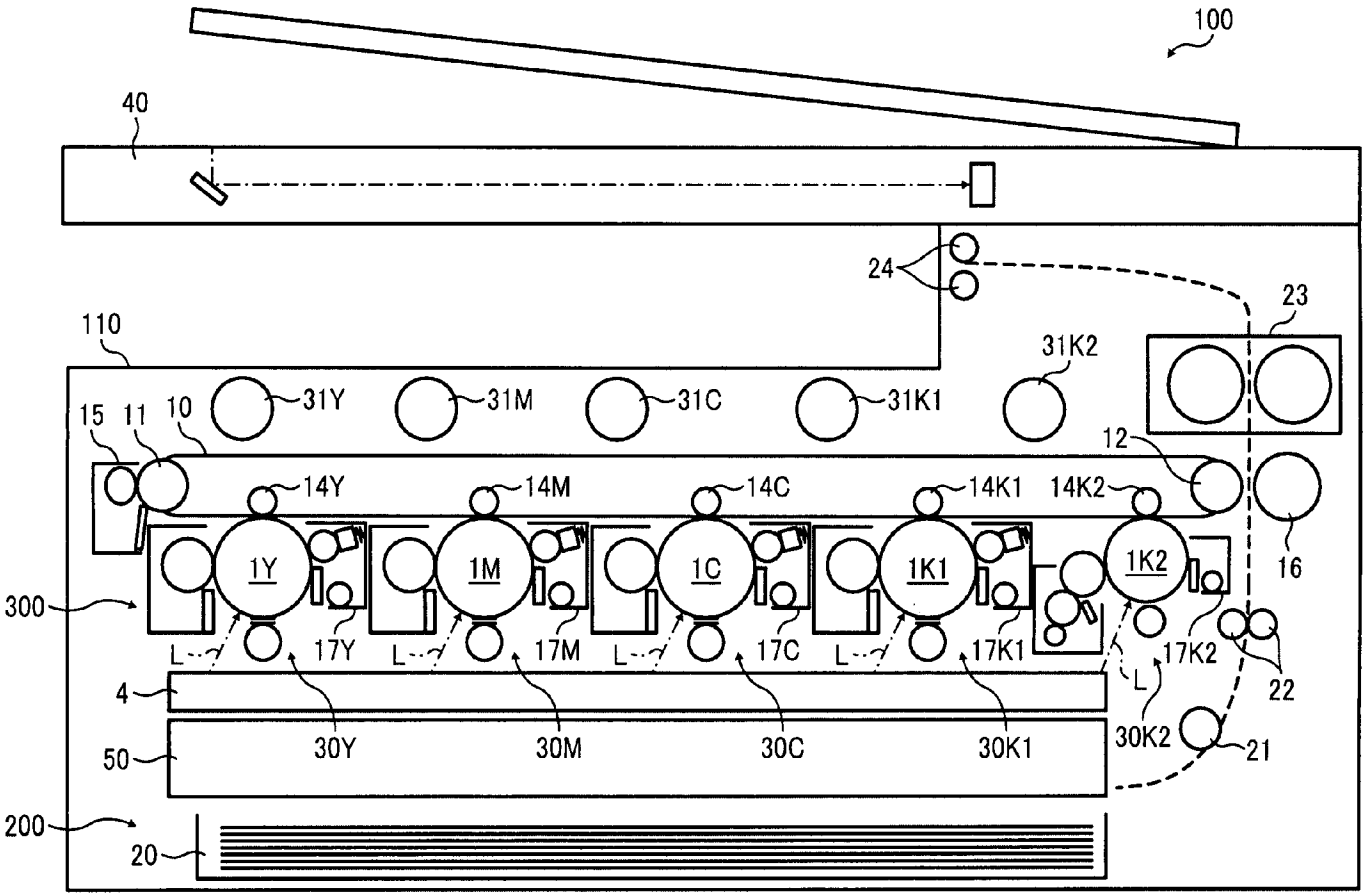
FIG. 1 is a cross-sectional view illustrating a schematic configuration of a copier according to an embodiment of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to the present invention. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of exemplary embodiments of the present invention.

The present invention includes a technique applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

In an embodiment of the present invention, two types of black toner image forming units are employed to form black toner images, one of which is a dry type development method and the other is a liquid type development method.

Figure 2:
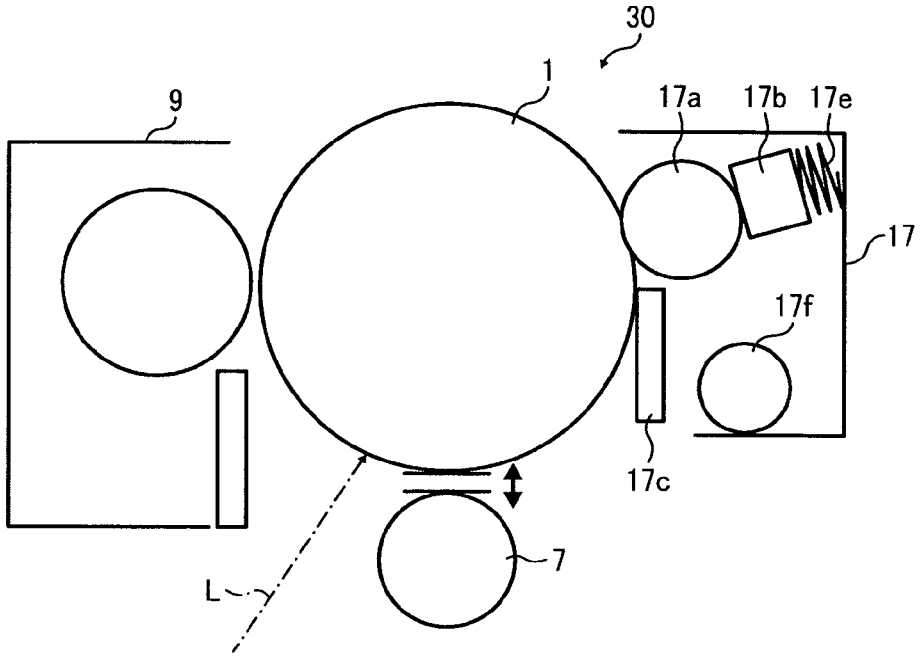
FIG. 2 is a cross-sectional view illustrating a schematic configuration of a dry-toner-type image forming unit according to an embodiment of the present invention.
Figure 3:
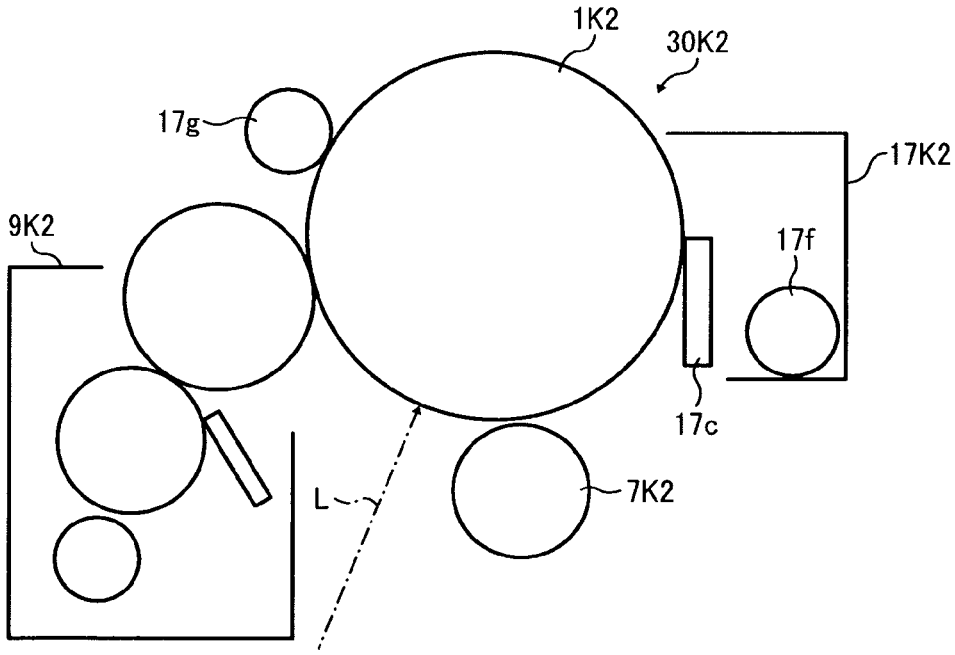
FIG. 3 is a cross-sectional view illustrating a schematic configuration of a wet-toner-type image forming unit according to an embodiment of the present invention.

Referring to FIGS. 1 through 3, descriptions are given of a schematic configuration of a copier 100 serving as a tandem-type electrophotographic image forming apparatus according to an embodiment of the present invention.

FIG. 1 is a cross-sectional view illustrating a schematic configuration of the copier 100 according to an embodiment of the present invention. FIG. 2 is a cross-sectional view illustrating a schematic configuration of any one of color image forming units 30Y, 30M, and 30C and a first black image forming unit 30K1 provided in the copier 100. The color image forming units 30Y, 30M, and 30C and the first black image forming unit 30K1 use dry toner to form respective toner images. FIG. 3 is a cross-sectional view illustrating a schematic configuration of a second black image forming unit 30K2 provided in the copier 100. The second black image forming unit 30K2 uses wet toner to form a black toner image.

The copier 100 of FIG. 1 includes a sheet feeding mechanism 200 including a sheet feeding cassette 20 that accommodates sheets serving as recording media at a lower portion of a main body 110 thereof. The copier 100 further includes an image forming mechanism 300 above the sheet feeding mechanism.

The image forming mechanism 300 includes multiple image forming units (i.e., five image forming units 30Y, 30M, 30C, 30K1, and 30K2), an intermediate transfer belt 10, an optical writing unit 4, and a fixing unit 23. The five image forming units 30Y, 30M, 30C, 30K1, and 30K2 include photoconductors 1Y, 1M, 1C, 1K1, and 1K2, and cleaning units 17Y, 17M, 17C, 17K1, and 17K2, respectively. In a case in which there is no need to specify color difference, the photoconductors 1Y, 1M, 1C, 1K1, and 1K2 can be referred to as photoconductor(s) 1 and the cleaning units 17Y, 17M, 17C, 17K1, and 17K2 can be referred to as cleaning unit(s) 17. Each of the photoconductors 1 serves as an image carrier.

The intermediate transfer belt 10 serves as an intermediate transfer member that includes an elastic endless belt wound around rollers 11 and 12. The optical writing unit 4 serves as an optical latent image forming unit to form a latent image on a surface of each photoconductor 1. The fixing unit 23 fixes a toner image to a sheet serving as a recording medium.

A sheet conveyance pathway to convey the sheet is defined between the sheet feeding cassette 20 and the fixing unit 23.

The copier 100 further includes a pickup roller 21 and a pair of registration rollers 22.

A distance between the rollers 11 and 12 around which the intermediate transfer belt 10 is wound with tension corresponds to a lower moving side of the intermediate transfer belt 10.

A secondary transfer roller 16 that serves as a secondary transfer member is disposed facing the roller 12 with the intermediate transfer belt 10 interposed therebetween, through which the sheet conveyance pathway extends.

A belt cleaning unit 15 that cleans a surface of the intermediate transfer belt 10 is disposed facing the roller 11.

The image forming mechanism 300 is disposed at a position below the intermediate transfer belt 10 by facing the lower moving side of the intermediate transfer belt 10. Each of the image forming units 30Y, 30M, 30C, 30K1, and 30K2 includes the photoconductors 1Y, 1M, 1C, 1K1, and 1K2, respectively.

As illustrated in FIG. 2, a charging roller 7 serving as a charging unit, a developing unit 9, and a cleaning unit 17 are disposed around each photoconductor 1 of the image forming unit 1. Primary transfer rollers 14 (i.e., primary transfer rollers 14Y, 14M, 14C, 14K1, and 14K2 of FIG. 1) that serve as primary transfer members are disposed inside the loop of the intermediate transfer belt 10, facing the photoconductors 1 with the intermediate transfer belt 10 interposed therebetween. The primary transfer rollers 14 can be moved vertically according to printing modes.

The optical writing unit 4 emits optically modulated laser light beams L to the respective surfaces of the photoconductors 1 so as to form respective electrostatic latent images of different single color toners thereon. The optical writing unit 4 is disposed at a position below the image forming mechanism 300.

Further, as illustrated in FIG. 1, toner bottles 31Y, 31M, 31C, 31K1, and 31K2 are disposed at a position above the main body 110 of the copier 100. In a case in which there is no need to specify color difference, the toner bottles 31Y, 31M, 31C, 31K1, and 31K2 are referred to as toner bottles 31.

Generally, toner is replenished by replacing the toner bottles 31 only and the photoconductor 1 and the charging roller 7 that have reached the end of service life are changed by replacing an entire unit of the image forming unit 30, which is corresponds to and also referred to as a process cartridge 30. As previously described, the first black image forming unit 30K1 uses dry toner and the second black image forming unit 30K2 uses wet toner.

As illustrated in FIG. 1, the toner bottles 31 that accommodate respective colors of toners are disposed at an upper portion of the main body 110 of the copier 100 to convey the respective toners from the toner bottles 31 to the respective process cartridges 30. According to this configuration, toner can be replenished by replacing the toner bottle 31 only, which can reduce the cost for user. Further, the user can reduce the number of opening and closing covers and other parts of the copier 100 and the number of putting in and taking out of units and components used for the copier 100, and therefore occurrence of toner scattering at shutters and other portions can be prevented, thereby enhancing the maintenance ability of the copier 100

When an image forming operation starts, the photoconductor 1 of each of the image forming units 30 (i.e., each of the process cartridges 30) illustrated in FIG. 2 is rotated by a driving unit in a clockwise direction so that the charging roller 7 can uniformly charge the surface of the photoconductor 1 to a predetermined polarity. The optical writing unit 4 then emits the laser light beam L to the charged surface of the photoconductor 1 to form an electrostatic latent image on the surface of the photoconductor 1. In this case, a full-color image read by a scanner 40, for example, is calculated and separated by an operating unit to different colors of yellow, cyan, magenta, and black image data to be irritated to respective photoconductors 1 for forming respective electrostatic latent images. When each of the respective electrostatic latent images passes between the photoconductor 1 and the developing unit 9, the developing unit 9 supplies toner contained therein to the electrostatic latent image so as to develop the electrostatic latent image into a visible toner image.

A driving unit rotates one of the rollers 11 and 12 that extend the intermediate transfer belt 10 in a counterclockwise direction so as to move the intermediate transfer belt 10 and cause the other roller of the rollers 11 and 12 to rotate with the intermediate transfer belt 10. The primary transfer rollers 14 cause the respective single toner images to be transferred sequentially onto the moving intermediate transfer belt 10 so that a full-color toner image is formed on the surface of the intermediate transfer belt 10.

After transfer of the single toner images formed on the photoconductors 1 onto the surface of the intermediate transfer belt 10, each of the cleaning units 17 removes residual toner remaining on the photoconductor 1 from the surface thereof. An electric discharging unit discharges the surface of the photoconductor 1 electrically to initialize the surface potential of the photoconductor 1 so that the photoconductor 1 can be ready for a subsequent image forming operation.

During the above-described operation, a sheet serving as a recording medium fed from the sheet feeding cassette 20 is conveyed to the sheet conveyance pathway and stopped at the pair of registration rollers 22 that is disposed upstream from the secondary transfer roller 16 in a sheet conveyance direction. In synchronization with movement of the toner image formed on the intermediate transfer belt 10, the pair of registration rollers 22 starts to convey the sheet to a nip area formed between the roller 12 and the secondary transfer roller 16. In this case, a transfer voltage that has a polarity opposite to a toner charging polarity of the toner image formed on the surface of the intermediate transfer belt 10 is applied to the secondary transfer roller 16. With this operation, the toner image formed on the surface of the intermediate transfer belt 10 can be transferred onto the sheet. The sheet having the toner image thereon is conveyed to the fixing unit 23 where the toner adhering to the sheet is melt by application of heat and pressure to fix the toner image to the sheet.

The sheet to which the toner image is fixed, i.e., a printed sheet, is conveyed to a pair of discharging rollers 24 disposed at a distal end of the sheet conveyance pathway arranged at an upper portion of the main body 110 of the copier 100 and is discharged to a sheet stacker located on top of the main body 110 of the copier 100.

After transfer of the toner image onto the sheet, residual toner or toner remaining on the surface of the intermediate transfer belt 10 is removed by the belt cleaning unit 15.

Further, the residual toner removed by the belt cleaning unit 15 and the residual toner removed by a cleaning blade 17*c* (see FIG. 2) of the cleaning unit 17 disposed in each of the image forming units 30 are conveyed by a toner conveyance coil 17*f* (see FIG. 2) to be collected in a waste toner collecting unit 50 (see FIG. 1).

The copier 100 has the above-described configuration in which four image forming units 30 (i.e., the image forming units 30Y, 30M, 30C, and 30K1) are disposed facing the intermediate transfer belt 10. When the color image printing mode is selected, respective single color toner images are sequentially transferred onto the intermediate transfer belt 10 to form an overlaid or composite color toner image. Therefore, when compared to an image forming apparatus that includes one image forming unit and four developing units to transfer single toner images onto an intermediate transfer belt and then onto a recording medium, the copier 100 of tandem type can reduce a period of time for image forming operation significantly. Further, since the copier 100 includes the sheet stacker formed on top of the main body 110, the sheet stacker fits within the size of the main body 110 without any protruding portions, and therefore the footprint of the copier 100 can be reduced.

Other than the above-described full color printing operation, a single color image can be printed by using one of the image forming units 30 of the image forming mechanism 300 or a two- or three-color image can be printed by using two or three of the image forming units 30.

Further, when printing a monochrome image in the copier 100 according to an embodiment of the present invention, an electrostatic latent image is formed only on the photoconductor 1K2 that contains wet black toner and developed in the second black image forming unit 30K2 to transfer the monochrome toner image onto the sheet and fix monochrome toner image in the fixing unit 23.

As previously described, the image forming units 30 are also referred to as the process cartridges 30 in which the photoconductor 1, the developing unit 9, the cleaning unit 17, and the charging roller 7 are integrally installed.

Next, descriptions are given of each of the image forming units 30 or the process cartridges 30.

The image forming unit 30 or the process cartridge 30 illustrated in FIG. 2 is a dry toner image forming unit that corresponds to any of the color image forming units 30Y, 30M, and 30C and the first black image forming unit 30K1.

The photoconductor 1 is disposed facing the developing unit 9. The cleaning unit 17 includes a lubricant applicator and the cleaning blade 17*c*. The lubricant applicator includes a brush roller 17*a*, a solid lubricant 17*b*, and a pressure spring 17*e*. Further, the charging roller 7 is disposed downstream from the cleaning unit 17. In FIG. 2, the charging roller 7 is illustrated with a small gap from the photoconductor 1. However, the charging roller 7 can contact the photoconductor 1.

A linear velocity of the lubricant application brush roller 17*a* is measured at a position where the lubricant application brush roller 17*a* contacts the surface of the photoconductor 1, and is set to be slightly faster with respect to the linear velocity of the photoconductor 1.

Specifically, the lubricant application brush roller 17*a* has a diameter of approximately 12 mm, the photoconductor 1 has a diameter of approximately 30 mm, and a contact depth of the lubricant application brush roller 17*a* to the photoconductor 1 is approximately 1 mm. Consequently, the substantive diameter of the lubricant application brush roller 17*a* at the position where the lubricant application brush roller 17*a* contacts the photoconductor 1 is approximately 10 mm. Therefore, the linear velocity of the lubricant application brush roller 17*a* described here is calculated based on data that the diameter of the photoconductor 1 is approximately 30 mm and the diameter of the lubricant application brush roller 17*a* is approximately 10 mm. Even if the diameter of a single form of the lubricant application brush roller 17*a* remains same, when the setting of the contact depth of the lubricant application brush roller 17*a* to the photoconductor 1 (i.e., a distance between a center of the photoconductor 1 and a center of the lubricant application brush roller 17*a*) is changed, the linear velocity of the lubricant application brush roller 17*a* described here can change. Therefore, the value may be selectively altered in a suitable manner.

The lubricant application brush roller 17*a* can include acrylic fiber, nylon fiber, PET fiber or the like and the lubricant 17*b* can include solid zinc stearate. When the pressure spring 17*e* presses the lubricant 17*b* against the lubricant application brush roller 17*a* with a suitable pressure, it is desirable or preferable that a linear velocity "X" of the lubricant application brush roller 17*a* is set in a range of 0.8 times≤X<1 time or 1 time<X≤1.3 times as the linear velocity of the photoconductor 1. It is more preferable that the linear velocity of the lubricant application brush roller 17*a* is set in a range of 1 time<X≤1.3 times as the linear velocity of the photoconductor 1.

Further, as illustrated in FIG. 2, the lubricant application brush roller 17*a* is disposed upstream from the cleaning blade 17*c* in a rotation direction of the photoconductor 1 so that the lubricant application brush roller 17*a* can also serve as a cleaning support unit to remove the residual toner remaining on the surface of the photoconductor 1. As a result, the effect of the lubricant application brush roller 17*a* in this configuration can solve a concern of cleaning failure caused by wear of a cleaning blade having an extended service life cycle.

Further, a flicker member is disposed at a position before where the lubricant application brush roller 17*a* contacts the lubricant 17*b* in the cleaning unit 17. With this configuration, in a case in which residual toner remains on the surface of the photoconductor 1 even after the lubricant application brush roller 17*a* has collected most of the residual toner from the surface of the photoconductor 1, the flicker member can remove the residual toner adhering to the surface of the photoconductor 1 so that the residual toner carried over on the photoconductor 1 may be reduced, thereby effectively applying the lubricant 17*b* to the photoconductor 1 having a less amount of the residual toner. The pressure spring 17*e* serves as a biasing member to press the lubricant 17*b* against the lubricant application brush roller 17*a*.

In this embodiment, a coil spring (i.e., the pressure spring 17*e*) is employed to serve as a biasing member for controlling an amount of the lubricant 17*b* to consume, but is not limited to. For example, a spindle using a gravity drop is applicable instead of the spring.

The image forming unit or the process cartridge illustrated in FIG. 3 is a wet toner image forming unit that corresponds to the second black image forming unit 30K2. Different from the dry toner image forming unit (i.e., the image forming units 30Y, 30M, 30C, and 30K1), the wet toner image forming unit (i.e., the second black image forming unit 30K2) includes a developing unit 9K2 in which an agitation roller, a toner supply roller, and a developing roller are included. The developing roller of the developing unit 9K2 is disposed in contact with the photoconductor 1K2 to develop an electrostatic latent image into a visible toner image. Further, the second black image forming unit 30K2 includes a charging roller 7K2 that is spaced from the photoconductor 1K2, which is similar to the dry toner other image forming units 30. The charging roller 7K2 spaced from the photoconductor 1K2 can charge the surface of the photoconductor 1K2 with a corona charging method but a method of charging the photoconductor 1K2 is not limited thereto.

Further, the second black image forming unit 30K2 illustrated in FIG. 3 includes the cleaning blade 17*c*, the toner conveyance coil 17*f*, and a squeeze roller 17*g*. The cleaning blade 17*c* and the toner conveyance coil 17*f* may be denoted by the same reference numerals as those provided in the image forming unit 30 illustrated in FIG. 2 and the descriptions thereof are omitted. The squeeze roller 17*g* is unique to the wet toner image forming unit 30K2 and disposed at a position downstream from the developing unit 9K2 that includes the developing roller contacting the photoconductor 1K2. Before the primary transfer operation, the squeeze roller 17*g* collects carrier liquid from a toner film, which is residual toner in a film-form remaining on the surface of the photoconductor 1K2 even after the development. Removal of the toner film is necessary to prevent the carrier that is required in the transfer and development operations from hardening the toner resin in the fixing operation. According to the reason above, it is desired to control the amount of carrier in the toner film before the fixing operation is performed. Another squeeze roller may be provided for a transfer roller. However, since the wet black toner of the second black image forming unit 30K2 can form a monochrome or black toner image without overlaying color toner images, an amount of carrier liquid to be collected by the squeeze roller 17*g* can be substantially small and a unit to squeeze and collect the carrier liquid is not needed excessively.

In this embodiment, the fixing temperature can be varied between when an image is printed in a color image printing mode and when an image is printed in a monochrome image printing mode. In this case, a glass transition temperature (Tg) and a softening point (Tm) of the toner can be decreased, and therefore a fixing temperature can be set lower, thereby achieving to obtain a power-saving apparatus.

Further, in this embodiment, the wet toner can be a non-volatile, highly-concentrated liquid toner. Between two types of the liquid toner, which are a volatile toner and a non-volatile toner, it is desirable to use a non-volatile wet toner in this embodiment according to a view point of environmental regulation.

Further, in this embodiment, each of the dry toner image forming units 30 can include an organic photoconductor (OPC) drum and the wet toner image forming unit 30K2 can include an amorphous silicon photoconductor drum. If an OPC drum is used in the wet toner image forming unit 30K2, liquid carrier may contaminate an OPC layer of the photoconductor 1K, prohibiting favorable image forming operation. Therefore, the OPC drum is not suitable for use in the wet toner image forming unit 30K2. Therefore, an amorphous silicon photoconductor drum that has good abrasion resistance is used in the wet toner image forming unit 30K2.

Further, in this embodiment, the photoconductor 1 of each of the image forming units 30 can be configured to contact with and separate from the intermediate transfer belt 10 according to the selection between the color image printing mode and the monochrome image printing mode. This configuration can prevent that dry toner on the intermediate transfer belt 10 is mixed into the wet toner image forming unit 30K2 and that wet toner on the intermediate transfer belt 10 is mixed into the dry toner image forming units 30. This can extend the service life of each image forming unit 30.

In the above-described embodiment, the copier 100 includes the first black image forming unit 30K1 used for color image printing and the second black image forming unit 30K2 used for monochrome image printing. According to this configuration, the service life of the first and second black image forming units 30K1 and 30K2 can be longer than the service life of the color image forming units 30Y, 30M, and 30C.

Further, in the above-described embodiment, the second black toner image forming unit 30K2 can use a wet toner developing method therein, thereby decreasing the fixing temperature. In one of the characteristics of wet toner developing, toner particles are wrapped by liquid that is called "carrier", so that the glass transition temperature (Tg) and the softening point (Tm) of each toner particle can be decreased. Thus, the temperature required to melt toner particles can be lower, and therefore the temperature of the fixing operation can be set lower, thereby achieving low-temperature fixing.

As previously described, the image forming unit 30 corresponds to the process cartridge 30 in which image forming components and members are integrally incorporated. Further, the image forming unit 30 is removably installable in the main body 110 of the copier 100.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

The invention claimed is:

1. A tandem-type electrophotographic image forming apparatus, comprising:

multiple color image forming units configured to use a color dry toner;

a first black image forming unit configured to use a black dry toner; and a second black image forming unit configured to use a black wet toner, wherein the image formed in the second printing mode with the wet toner is fixed to a recording medium at a temperature lower than the image formed in the first printing mode with the dry toner.

2. The tandem-type electrophotographic image forming apparatus according to claim 1, wherein the wet toner is a non-volatile, high-concentrated liquid toner.

3. The tandem-type electrophotographic image forming apparatus according to claim 1, wherein each of the multiple color image forming units and the first black image forming unit using the dry toner includes an image carrier formed by organic photoconductor (OPC) and the second black image forming unit using the wet toner includes an image carrier formed by amorphous silicon.

4. The tandem-type electrophotographic image forming apparatus according to claim 1, wherein the image carrier of each image forming units is determined to either contact with or separate from a transfer belt, depending on selection of the first printing mode and the second printing mode.

5. The tandem-type electrophotographic image forming apparatus according to claim 4, wherein the first black image forming unit is used for color image printing, and the second black image forming unit is used for monochrome image printing.

6. A process cartridge, comprising:

an image carrier; and at least one of a charging unit, a developing unit, and a cleaning unit, the process cartridge removably installable in the tandem-type electrophotographic image forming apparatus according to claim 1 and corresponding to any one of the multiple color image forming units, the first black image forming unit, and the second black image forming unit according to claim 1.

7. The tandem-type electrophotographic image forming apparatus according to claim 1, wherein the second black image forming unit comprises, a photoconductor; and a squeeze roller configured to collect residual toner from the photoconductor.

8. A tandem-type electrophotographic image forming apparatus, comprising:

multiple color image forming units configured to use a color dry toner;

a first black image forming unit configured to use a black dry toner; and a second black image forming unit configured to use a black wet toner, wherein each of the multiple color image forming units and the first black image forming unit using the dry toner includes an image carrier formed by organic photoconductor (OPC) and the second black image forming unit using the wet toner includes an image carrier formed by amorphous silicon.

9. A tandem-type electrophotographic image forming apparatus, comprising:

multiple color image forming units using a color dry toner;

a first black image forming unit using a black dry toner; and a second black image forming unit using a black wet toner, wherein the tandem-type electrophotographic image forming apparatus performs an image formation in a first printing mode and a second printing mode based on a type of toner, and wherein an image carrier of each image forming units is determined to either contact with or separate from a transfer belt, depending on selection of the first printing mode and the second printing mode.

* * * * *